US009001022B2

(12) United States Patent
Kim et al.

(10) Patent No.: US 9,001,022 B2
(45) Date of Patent: Apr. 7, 2015

(54) LIQUID CRYSTAL DISPLAY DEVICE USING A DIMMING CONTROL METHOD AND METHOD FOR DRIVING THE SAME

(75) Inventors: DongWoo Kim, Seoul (KR); DaeHo Cho, Paju-si (KR); Junghwan Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 62 days.

(21) Appl. No.: 13/540,311

(22) Filed: Jul. 2, 2012

(65) Prior Publication Data

US 2013/0009976 A1 Jan. 10, 2013

(30) Foreign Application Priority Data

Jul. 4, 2011 (KR) ..... 10-2011-0066105

(51) Int. Cl.
*G09G 3/36* (2006.01)
*G09G 3/34* (2006.01)

(52) U.S. Cl.
CPC ..... *G09G 3/3406* (2013.01); *G09G 3/3648* (2013.01); *G09G 2320/0646* (2013.01); *G09G 2320/0653* (2013.01)

(58) Field of Classification Search
CPC ..... G09G 3/3406; G09G 2320/0646; G09G 2360/16
USPC ..... 345/102, 204, 547
See application file for complete search history.

(56) References Cited

U.S. PATENT DOCUMENTS

| | | | | |
|---|---|---|---|---|
| 2004/0017348 | A1* | 1/2004 | Numao | 345/92 |
| 2005/0140617 | A1 | 6/2005 | Jang et al. | |
| 2007/0024213 | A1* | 2/2007 | Shteynberg et al. | 315/291 |
| 2007/0091056 | A1* | 4/2007 | Okita et al. | 345/102 |
| 2008/0180381 | A1 | 7/2008 | Jeong et al. | |
| 2008/0238856 | A1* | 10/2008 | Bhowmik et al. | 345/102 |
| 2009/0152445 | A1* | 6/2009 | Gardner, Jr. | 250/214 AL |
| 2010/0295879 | A1* | 11/2010 | Tanaka et al. | 345/690 |

FOREIGN PATENT DOCUMENTS

| | | | |
|---|---|---|---|
| CN | 1637477 | A | 7/2005 |
| CN | 101231824 | A | 7/2008 |
| CN | 101339742 | A | 1/2009 |
| CN | 101562936 | A | 10/2009 |
| CN | 101841949 | A | 9/2010 |
| CN | 101889304 | A | 11/2010 |
| CN | 101894532 | A | 11/2010 |
| TW | I376660 | B | 11/2012 |

* cited by examiner

*Primary Examiner* — Jonathan Blancha
(74) *Attorney, Agent, or Firm* — Birch, Stewart, Kolasch & Birch, LLP

(57) ABSTRACT

An LCD device and a driving method thereof are provided. The LCD device includes a panel, a timing controller, and a backlight unit. The panel is driven by a data driver and a gate driver. The timing controller controls the data driver and the gate driver. The backlight unit turns on or off a light source according to a dimming control signal transferred from the timing controller. The backlight unit is configured such that a turn-off delay time of a light source turned off according to the dimming control signal is shorter than a turn-on delay time of a light source turned on according to the dimming control signal.

11 Claims, 5 Drawing Sheets

LIQUID CRYSTAL DISPLAY DEVICE USING A DIMMING CONTROL METHOD AND METHOD FOR DRIVING THE SAME

CROSS-REFERENCE TO RELATED APPLICATIONS

This application claims the benefit of the Korean Patent Application No. 10-2011-0066105 filed on Jul. 4, 2011, which is hereby incorporated by reference as if fully set forth herein.

BACKGROUND

1. Field of the Invention

The present invention relates to a liquid crystal display (LCD) device, and more particularly, to an LCD device using a dimming control method and a driving method thereof.

2. Discussion of the Related Art

LCD devices are light and thin, and are driven with low consumption power. Due to such features, the application of LCD devices is increasingly broadened. Therefore, LCD devices are being applied to office automation equipment, audio/video equipment, portable computers such as notebook computers, etc.

Generally, in LCD devices, the amount of transmitted light is controlled according to a plurality of image signals respectively applied to a plurality of control switching elements that are arranged in a matrix type, and thus, a desired image is displayed on a screen.

LCD devices include a liquid crystal panel having a color filter substrate that is an upper substrate, a thin film transistor array substrate that is a lower substrate and a liquid crystal layer that is formed of liquid crystal filled between the upper substrate and the lower substrate, and a driver that supplies a scan signal and image information to the liquid crystal panel to drive the liquid crystal panel.

In LCD devices having the above-described configuration, consumers' demand for a model with minimized consumption power is recently increasing, and thus, various methods for minimizing consumption power are being proposed.

Among the various methods for minimizing consumption power, as a widely-used method, there is a dimming control method that controls the lighting time or light emission luminance of a backlight unit that consumes large power in driving an LCD device.

The dimming control method is categorized into a linear dimming control method and a burst dimming control method. The linear dimming control method is a method that adjusts the size of an input current (i.e., the amplitude level of the input current) that is supplied to a light source (lamp) of a backlight unit. The burst dimming control method is a method that adjusts an interval (i.e., the amplitude level of an input current) between the turn-on time and turn-off time of a light source (lamp) of a backlight unit.

Moreover, the dimming control method is categorized into a local dimming control method and a global dimming control method. The local dimming control method is a method that adjusts the brightness of a light source in units of a block according to image data. The global dimming control method is a method that turns on/off a light source overall according to image data.

FIG. 1 is a graph showing a relationship between luminance and time in applying a related art local dimming control method.

As described above, the local dimming control method is a method that repeatedly turns on/off a light source of a backlight unit in units of a block according to image data.

However, flicker is shown when the light source of the backlight unit is rapidly changed according to image data, and thus, a temporal filter algorithm that allows the light source to be slowly changed is being implemented recently.

As shown in FIG. 1, a temporal filter operates when a screen is changed from a dark screen to a bright screen or from a bright screen to a dark screen, and thus, the luminance of the backlight unit varies with time. Therefore, as shown in FIG. 1, a related art LCD device is implemented such that a time (a) taken while the luminance of the backlight unit rises is almost equal to a time (b) taken while the luminance of the backlight unit falls.

That is, by applying the local dimming control method, the related art LCD device is configured such that a time taken in turning off the backlight unit is almost equal to a time taken in turning on the backlight unit.

However, in the related art LCD device, the turn-off time of the backlight unit is the same as the turn-on time of the backlight unit, and thus, a power reduction effect due to dimming cannot be maximized.

SUMMARY

Accordingly, the present invention is directed to provide an LCD device and a driving method thereof that substantially obviate one or more problems due to limitations and disadvantages of the related art.

An aspect of the present invention is directed to provide an LCD device and a driving method thereof, which analyze whether a current timing of a backlight unit is a turn-on timing or a turn-off timing and thus allow a turn-off delay time to become shorter than a turn-on delay time, when turning on/off the backlight unit.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an LCD device including: a panel driven by a data driver and a gate driver; a timing controller controlling the data driver and the gate driver; and a backlight unit turning on or off a light source according to a dimming control signal transferred from the timing controller, wherein the backlight unit is configured such that a turn-off delay time of a light source turned off according to the dimming control signal is shorter than a turn-on delay time of a light source turned on according to the dimming control signal.

The backlight unit may include: a light source part comprising a plurality of light sources for emitting light; a power supply supplying power to the light source part for the light sources to emit light; and a light source driver controlling the power supply or the light source part according to the dimming control signal to turn on or off a light source corresponding to the dimming control signal, when the dimming control signal is received from the timing controller.

The light source part or the power supply may be configured with at least one switch or capacitor such that a turn-off delay time taken until a light source is turned off according to an off-dimming control signal is shorter than a turn-on delay time taken until a light source is turned on according to an on-dimming control signal, when the dimming control signal is the off-dimming control signal.

Each of the light sources may include a light emitting diode (LED) string whose at least one or more LEDs turned on or off simultaneously according to the dimming control signal are connected, and each light source including the LED string may be turned on or off in units of a block according to the dimming control signal.

The timing controller may include: a receiver receiving a timing signal and video data from an external system; a buffer storing the video data, received through the receiver, by frame; a determiner comparing and analyzing each of blocks for the video data transferred from the buffer in units of a frame to determine which block includes a light source to be turned on or off; and a dimming control signal generator generating the dimming control signal for controlling the backlight unit according to the result determined by the determiner.

The backlight unit may be turned on or off in units of a block according to the dimming control signal.

In another aspect of the present invention, there is provided a driving method of an LCD device including: receiving video data; comparing and analyzing the received video data to determine whether luminance has been changed to more than a predetermined value; generating a dimming control signal for turning on or off a light source of a backlight unit according to the determined result; and turning on the light source of the backlight unit when the dimming control signal is an on-dimming control signal, and turning off the light source of the backlight unit when the dimming control signal is an off-dimming control signal, wherein a turn-off delay time of a light source turned off according to the off-dimming control signal is shorter than a turn-on delay time of a light source turned on according to the on-dimming control signal.

The driving method may further include storing the received video data by frame, wherein the determining of luminance change may include comparing and analyzing a current frame and a previous frame stored.

The determining of luminance change may include determining whether luminance has been changed to more than a predetermined value in units of a block of each frame.

In the turning on or off of the light source of the backlight unit, a light source driver of the backlight unit receiving the dimming control signal may control a power supply which supplies power necessary for the backlight unit, and vary a voltage or a current supplied to a light source which is turned on or off according to the dimming control signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Hereinafter, embodiments of the present invention will be described with reference to the accompanying drawings in detail. Wherever possible, the same reference numbers will be used throughout the drawings to refer to the same or like parts.

Figure 1:
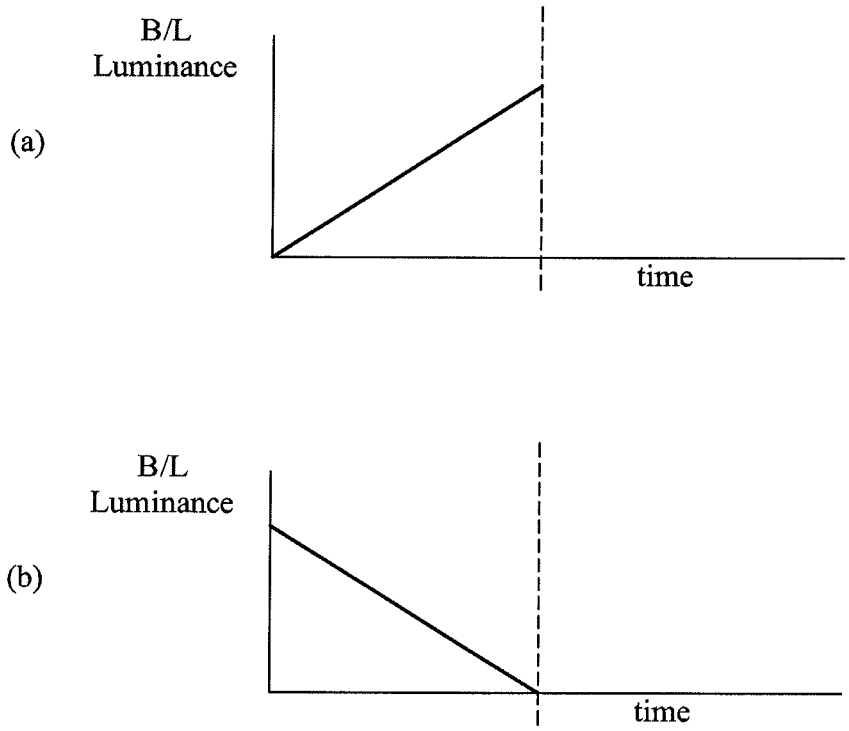
FIG. 1 is a graph showing a relationship between luminance and time in applying a related art local dimming control method.
Figure 2:
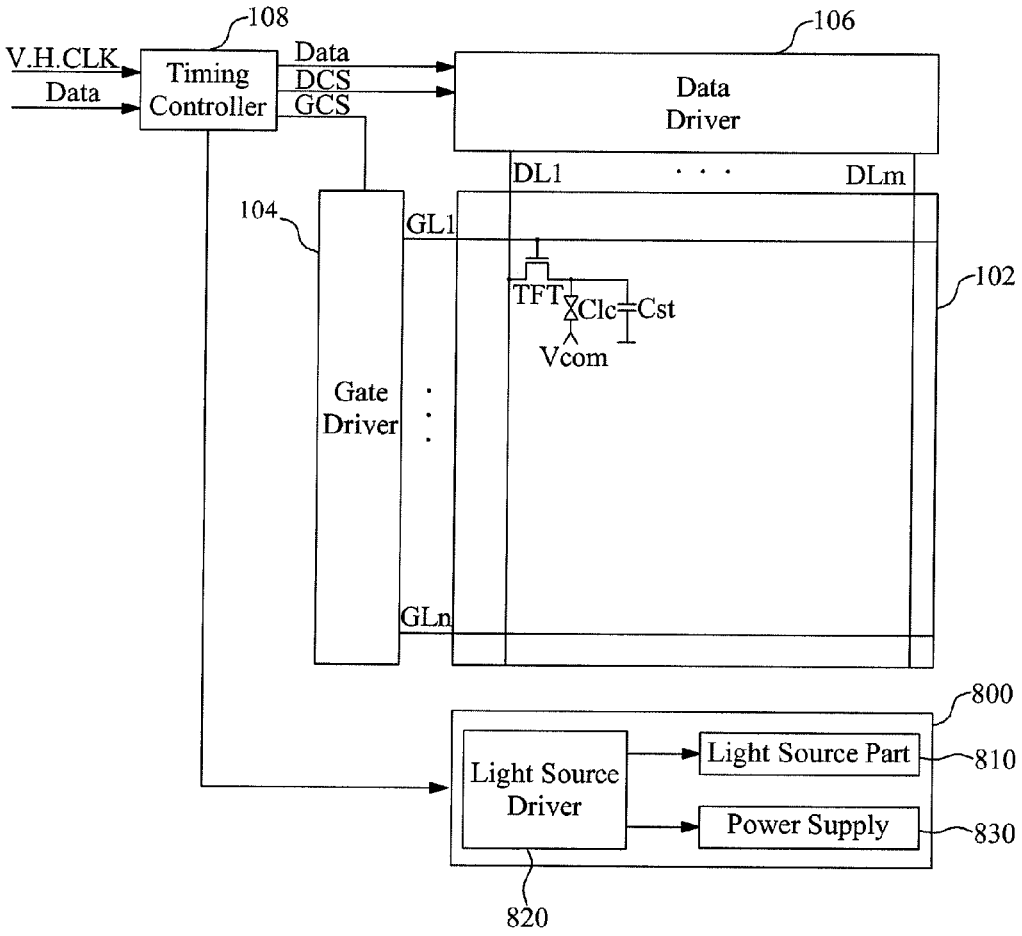
FIG. 2 is an exemplary diagram illustrating a configuration of an LCD device according to the present invention.

FIG. 2 is an exemplary diagram illustrating a configuration of an LCD device according to the present invention.

As illustrated in FIG. 2, the LCD device according to the present invention includes: a data driver 106 that drives a plurality of data lines DL1 to DLm; a gate driver 104 that drives a plurality of gate lines GL1 to GLn; a panel 102 that is driven by the data driver 106 and the gate driver 104; a timing controller 108 that controls the data driver 106 and the gate driver 104; and a backlight unit 800 that turns on/off a light source according to a dimming control signal transferred from the timing controller 108.

The panel 102 includes: the gate lines GL1 to GLn and the data lines DL1 to DLm that intersect and thus define a plurality of pixel areas, in an active area; a thin film transistors TFT that is formed in a portion where each of the gate lines GL and each of the data lines DL intersect; a liquid crystal capacitor Clc that is connected to the thin film transistor TFT and formed in each of the pixel areas; and a storage capacitor Cst that is parallel-connected to the liquid crystal capacitor Clc.

The liquid crystal capacitor Clc has liquid crystal injected between a common electrode and a pixel electrode that is connected to the thin film transistor TFT. The thin film transistor TFT is turned on with a gate-on voltage applied from a corresponding gate line GL and supplies a data voltage, applied from a corresponding data line, to the pixel electrode, thereby allowing a difference voltage between the data voltage and a common voltage to be charged into the liquid crystal capacitor Clc.

The thin film transistor TFT is turned off with a gate-off voltage Voff applied from a corresponding gate line GL, and allows a voltage charged into the liquid crystal capacitor Clc to be held. In this case, the storage capacitor Cst allows the voltage charged into the liquid crystal capacitor Clc to be stably held.

The gate driver 104 shifts a gate start pulse GSP transferred from the timing controller 108 to sequentially supply a scan pulse having a gate-on voltage Von to the gate lines GL1 to GLn according to a gate shift clock GSC. Furthermore, the gate driver 104 supplies a gate-off voltage Voff to the gate lines GL1 to GLn for a period where a scan pulse having the gate-on voltage Von is not supplied to the gate lines GL1 to GLn.

The data driver 106 shifts a source start pulse SSP supplied from the timing controller 108 to generate a sampling signal according to a source shift clock SSC. Furthermore, the data driver 106 latches pixel data RGB, which are inputted according to the source shift clock SSC, according to the sampling signal and then supplies the latched pixel data RGB in units of a horizontal line in response to a source output enable signal SOE.

The timing controller 108 generates a data control signal DCS for controlling the data driver 106 and gate control signal GCS for controlling the gate driver 104, with a plurality of timing signals such as a vertical sync signal V, a horizontal sync signal H, a data enable signal DE, and a dot clock DCLK that are inputted from the external system.

The data control signal DCS includes the source shift clock SSC, the source start pulse SSP, a polarity control signal POL, and a source output enable signal SOE.

The gate control signal GCS includes first and second gate start pulses GSP1 and GSP2, a clock signal RCLK, and a gate output enable signal GOE.

When turning on/off the backlight unit 800 according to a dimming control method, the timing controller 108 applied to the present invention analyzes whether a current timing of the backlight unit 800 is a turn-on timing or a turn-off timing and thus allows a turn-off time of the backlight unit 800 to become shorter than a turn-on delay time of the backlight unit 800. Accordingly, consumption power necessary for driving the backlight unit 800 is reduced.

The detailed configuration and function of the timing controller 108 will be described below with reference to FIGS. 3 to 6 in detail.

Since the panel 102 cannot self-emit light, the backlight unit 800 is disposed behind the panel 012 and irradiates light to the panel 102. The backlight unit 800 may include a light source part 810 that is configured with a plurality of light sources for emitting light; a power supply 830 that supplies power to the light source part 810 and thus allows the light sources to emit light; and a light source driver 820 that turns on/off a light source of a block corresponding to a dimming control signal by controlling the power supply 830 or the light source part 810 according to the dimming control signal when the dimming control signal is received from the timing controller 108.

First, the light source part 810 may be configured with at least one light source such as a light emitting diode (LED), an exterior electrode fluorescent lamp (EEFL), or cold cathode fluorescent lamp (CCFL). The light source part may be divided into a edge type and a direct type according to the arrangement of the light sources.

The present invention turns on/off the light source part 810 of the backlight unit 800 in units of a block according to input video data. The backlight unit 800 may be configured with a plurality of LEDs suitable for turn-on/off thereof. Therefore, for convenience of a description, the backlight unit 800 including LEDs as light sources will be described as an example below.

The light source part 810 applied to the present invention may be configured with various light sources for dimming driving. For example, the light source part 810 may be configured with LEDs as light sources, in which case the light source part 810 may be configured in an LED array type where an LED string (light source) with a plurality of LEDs parallelly disposed therein is disposed in plurality. That is, the light source part 810 may be configured with one of various light sources, and particularly, when the light source part 810 may be configured with LEDs as light sources, the LEDs may be arranged in a string type, in which case an LED string whose LEDs are simultaneously turned on/off may be called one light source.

To provide an additional description, the light sources may be disposed in each block of the panel 102 so as to irradiate light to a corresponding block of the panel 102. Particularly, when LEDs are used as light sources, at least one or more LEDs may configure one LED string in order to be turned on/off in units of a block in the panel 102, and emit light for a corresponding block. Therefore, when the light source part 810 is configured with LEDs, an LED string whose at least one or more LEDs are turned on/off simultaneously and connected to each other may be one light source.

Second, the light source driver 820 controls the level of a voltage outputted from the power supply 830 (a constant voltage driving method), or controls a current flowing through each light source (a constant current control method), thereby enabling the light sources to be driven stably. Particularly, the light source driver 820 applied to the present invention may be applied to LCD devices that are driven by the dimming control method. When an off-dimming control signal for turning off at least one LED string (turning off an LED string denotes that the LED string does not emit light) is received from the timing controller 108, the light source driver 810 cuts off a voltage or a current that is applied from the power supply 830 to a corresponding LED string, thereby turning off the corresponding LED string.

Moreover, when an on-dimming control signal for turning on at least one LED string is received from the timing controller 108, the light source driver 820 drives the power supply 830 and thus allows a voltage or a current to be supplied to a corresponding LED string, thereby turning on the corresponding LED string.

When the off-dimming control signal is received from the timing controller 108, the light source driver 820 applied to the present invention drives the power supply 830 or the light source part 820 such that a turn-off delay time where the light source is changed from a turn-on state to a turn-off state is faster than a turn-on delay time where the light source is changed from the turn-off state to the turn-on state, thus reducing power consumption.

For example, when the off-dimming control signal for turning off the light sources of a specific block is received from the timing controller 108, the light source driver 820 turns off a switch that is connected from the power supply 830 to the specific block, and thus minimizes a delay time to turn off the light sources of the specific block.

Moreover, when the on-dimming control signal for turning on the light sources of a specific block is received from the timing controller 108, the light source driver 820 may allow a current or a voltage applied to the light sources of the specific block to increase while having a certain delay time, by using elements such as capacitors. That is, when the on-dimming control signal for turning on the light sources of a specific block is received, the light source driver 820 drives the power supply 830 or the light source part 810 in a general driving method, and thus allows the light sources of the specific block to be turned on while having a general turn-on delay time.

To perform the above-described functions, the light source driver 820 may include a micro control unit (MCU), various integrated circuits, and various circuits.

Third, the power supply 830 supplies power to the light source part 810 according to a control by the light source driver 820. The power supply 830 may drive a plurality of light sources (which are disposed in each block) in units of a block.

When the light source driver 820 turns off the light sources of a specific block in the light source part 810, the present invention is characterized in that a turn-off delay time where the light sources of the specific block are turned off is shorter than a turn-on delay time where the light sources of the specific block are turned on. To this end, as described above, the light source part 810 or the power supply 830 may be configured in various types with a plurality of switches or capacitors.

Figure 3:
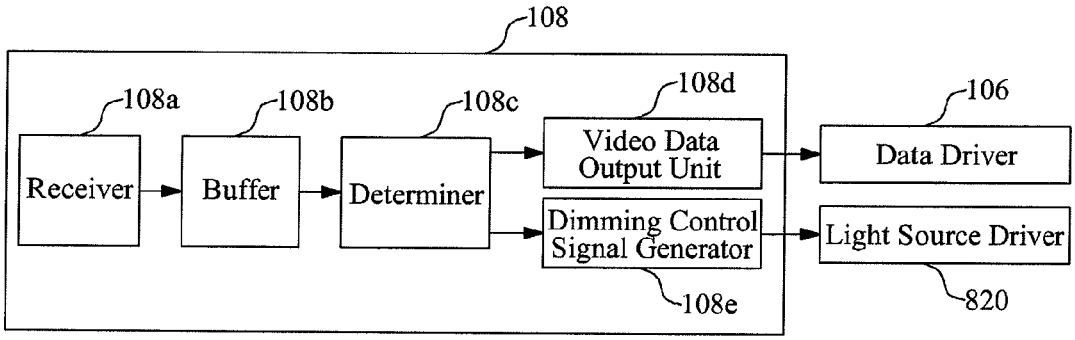
FIG. 3 is an exemplary diagram illustrating a configuration of a timing controller applied to an LCD device according to the present invention.

FIG. 3 is an exemplary diagram illustrating a configuration of a timing controller applied to an LCD device according to the present invention.

When turning on/off the backlight unit 800 according to a local dimming control method, the timing controller 108 applied to the present invention analyzes whether a current timing of the backlight unit 800 is a timing for turning on the backlight unit 800 or a timing for turning off the backlight unit 800, and allows a turn-off delay time for turning off the backlight unit 800 to become shorter than a turn-on delay time for turning on the backlight unit 800, thereby decreasing consumption power necessary for driving the backlight unit 800. To perform such a function, as illustrated in FIG. 3, the timing controller 108 includes: a receiver 108*a* that receives the timing signals such as the vertical sync signal V, the horizontal sync signal H, the data enable signal DE, and the dot clock DCLK, and video data from the external system; a buffer 108*b* that stores the video data, received through the receiver 108*b*, by frame; a determiner 108*c* that compares and analyzes blocks for the video data in units of a frame to determine which block includes light sources to be turned on/off; a video data output unit 108*d* that outputs video data passing through the determiner 108*c* to the data driver 106; and a dimming control signal generator 108*e* that generates the dimming control signal for controlling the light source driver 820 according to the result determined by the determiner 108*c*.

Although not shown, the timing controller 108 includes: a data aligner that samples the video data received from the external system, realigns the sampled data, and supplies the realigned data to the data driver 106; and a control signal generator that generates various control signals.

In the following description, as an example of the present invention, the timing controller 108 will be described as including elements that generate the dimming control signal to control the light source driver 820 of the backlight unit 800 similarly to the above description, but the elements (i.e., the receiver 108*a*, the buffer 108*b*, the determiner 108*c*, the image data output unit 108*d*, and the dimming control signal generator 108*e*) may be included in a separate controller instead of the timing controller 108.

The dimming control signal applied to the present invention is a signal that is generated for controlling backlight dimming which adjusts the luminance of the backlight unit 800 according to the video data. That is, the image quality of the LCD device depends on contrast characteristic, and a method that controls data voltages applied to the liquid crystal layer of the panel 102 to modulate the light transmittance of the liquid crystal layer has a limitation in improving the contract characteristic. Therefore, a backlight dimming control method that adjusts the luminance of the backlight unit 800 according to video data is being developed for improving the contract characteristic.

The backlight dimming control method includes: a global dimming method that overall turns off the light source part 810 of the backlight unit for adjusting the luminance of an entire display surface; and a local dimming method that turns off only the light sources of one or some of the blocks in the light source part 810, for locally adjusting the luminance of the display surface. The dimming control signal is a control signal that is transferred from the timing controller 108 or the separate controller to the light source driver 820 of the backlight unit 800, for executing the dimming control method.

To provide an additional description, the light source driver 820 turns on/off a current or a voltage that flows through the light sources of a specific block, according to the dimming control signal transferred from the timing controller 108 or the separate controller, thereby allowing the light sources of the specific block to emit light or not to emit light.

In the following description, disallowing a light source to emit light denotes the light source being turned off; and allowing a light source to emit light denotes the light source being turned on. A dimming control signal for the former is referred to as an off-dimming control signal, and a dimming control signal for the latter is referred to as an on-dimming control signal.

The dimming control method, as described above, includes the global dimming method and the local dimming method. Hereinafter, however, the local dimming control method (i.e., a method that allows only a specific light source of the light source part 810 to emit light or not to emit light) will be described as an example of the present invention. Therefore, in a case of using the global dimming control method, the below-described present invention may be applied as-is, except that the light source driver 820 simultaneously controls all light sources of the light source part 810 according to the present invention.

The receiver 108*a* is for receiving various information from the external system and, as described above, receives the timing signals such as the vertical sync signal V, the horizontal sync signal H, the data enable signal DE, and the dot clock DCLK, and video data RGB that will be outputted through the panel 102.

The buffer 108*b* stores video data (which are received through the receiver 108*a*) by frame, and sequentially outputs the video data.

The determiner 108*c* compares and analyzes video data inputted through the buffer 108*b* in units of a frame to determine which block the brightness (luminance) of video data has been changed in.

That is, in applying the local dimming control method, the determiner 108*c* compares and analyzes video data of each frame in units of a block to determine whether a corresponding block becomes brighter or darker than a previous frame.

The video data output unit 108*d* outputs video data that has passed through the determiner 108*c*. The video data outputted from the video data output unit 108*d* are realigned by the timing controller 108, and the realigned image data are transferred to the data driver 106. The realignment operation may be performed by the video data output unit 108*d*.

The dimming control signal generator 108*e* generates the dimming control signal that is intended to be transferred to the light source driver 820 of the backlight unit 800, according to the result determined by the determiner 108*c*.

For example, when it is determined by the determiner 108*c* that a specific block is darker than a previous frame, the dimming control signal generator 10*e* generates the off-dimming control signal, and transfers the off-dimming control signal to the light source driver 820. When it is determined by the determiner 108*c* that a specific block is brighter than a previous frame, the dimming control signal generator 10*e* generates the on-dimming control signal, and transfers the on-dimming control signal to the light source driver 820.

Figure 5:
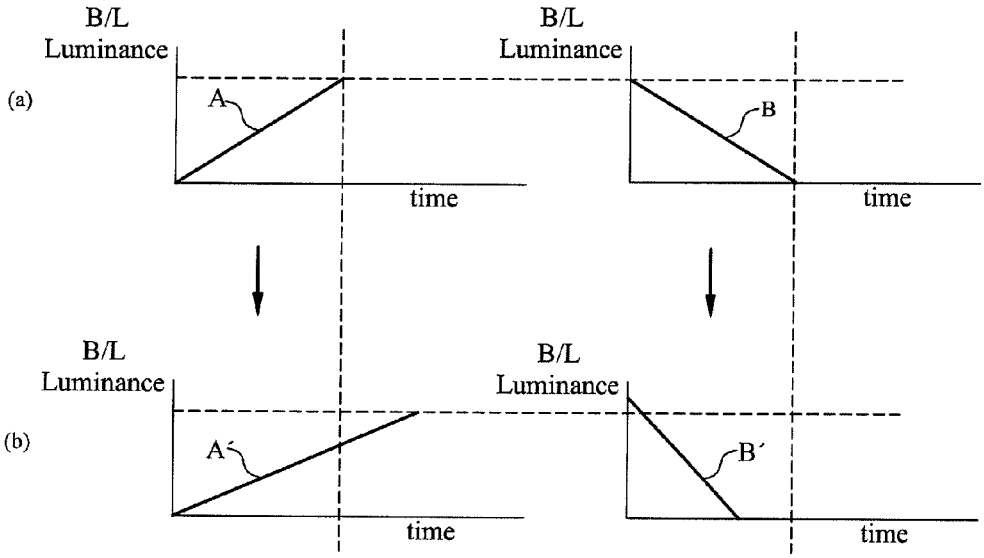
FIGS. 5 and 6 are exemplary diagrams for describing a change in a turn-on delay time and a turn-off delay time, in an LCD device according to the present invention and a related art LCD device.
Figure 6:
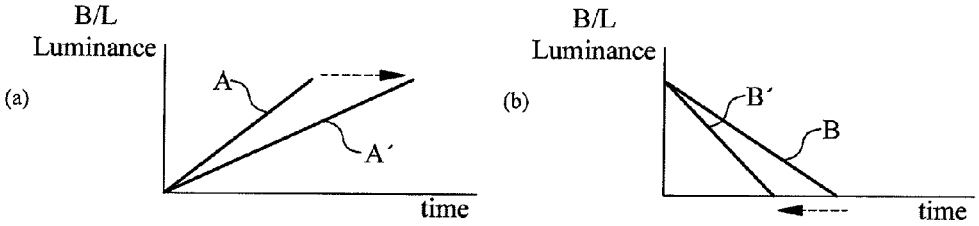

A method of generating the dimming control signal and an operation of the light source driver 820 using the same will be described below with reference to FIGS. 4 to 6 in detail.

Figure 4:
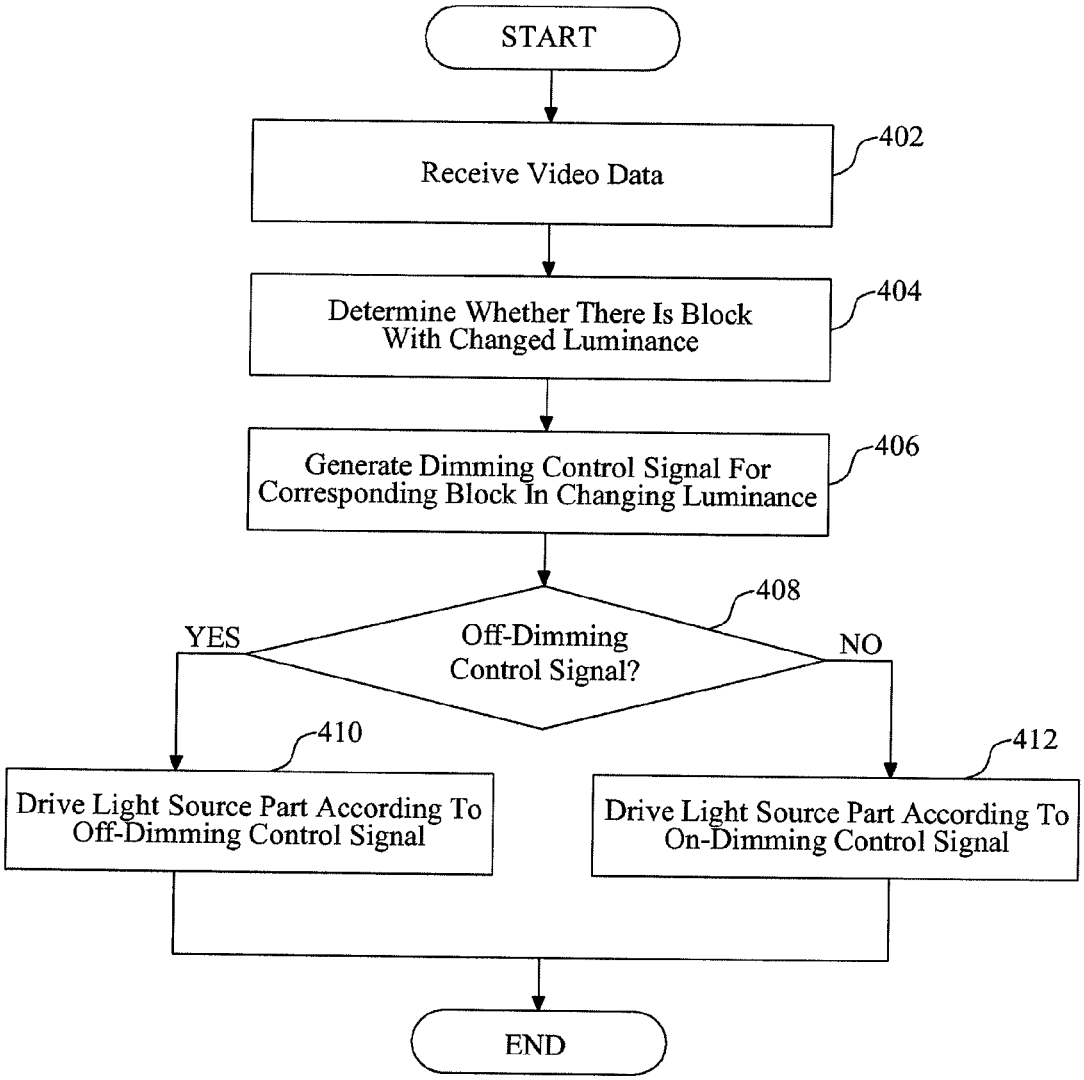
FIG. 4 is a flowchart illustrating a driving method of an LCD device according to the present invention.

FIG. 4 is a flowchart illustrating a driving method of an LCD device according to the present invention. FIGS. 5 and 6 are exemplary diagrams for describing a change in a turn-on delay time and a turn-off delay time, in an LCD device according to the present invention and a related art LCD device.

In the driving method of the LCD device according to the present invention, video data transferred from the external system are received through the receiver 108*a* of the timing controller 108, and the received video data are stored by frame in the buffer 108*b* and then are sequentially outputted to the determiner 108*c* in operation 402.

In operation 404, the determiner 108*c* compares and analyzes video data inputted through the buffer 108*b* in units of a frame to determine whether a corresponding block becomes brighter or darker than a previous frame, thereby determining whether there is a block with changed luminance. Here, the block with changed luminance denotes a block whose luminance has been changed to exceed a limit value that has been set for turning on/off a light source in the dimming control method applied to the present invention.

That is, since the luminance of an image signal outputted to the panel 102 is changed for each frame, dimming control cannot be performed according to all changes in luminance, and thus, when luminance is changed from a bright image to a very dark image, dimming control may be performed. Therefore, the determiner 108*c* stores setting information on the change in luminance that required the dimming control, and determines whether there is a block requiring the dimming control on the basis of the setting information.

The dimming control signal generator 108*e* generates the dimming control signal according to the result determined by the determiner 108*c* in operation 406. Here, the dimming control signal may be the off-dimming control signal for turning off a light source or the on-dimming control signal for turning on a light source. The dimming control signal is transferred to the light source driver 820 of the backlight unit 800.

The light source driver 820 receiving the dimming control signal determines whether a corresponding dimming control signal is the off-dimming control signal or the on-dimming control signal in operation 408.

In operation 410, when the dimming control signal is the off-dimming control signal, as described above, the light source driver 820 turns off a switch connected between the power supply 830 and a light source of a block for receiving the off-dimming control signal, and thus temporarily cuts off power applied to the light source of the block, thereby decreasing a turn-off delay time where the light source is changed from a turn-on state to a turn-off state.

In operation 412, when the dimming control signal is the on-dimming control signal, as described above, the light source driver 820 supplies power to a light source of a corresponding block according to a general driving method, the light source of the corresponding block may be changed to a turn-on state while having a general turn-on delay time. However, the light source driver 820 or the light source part 810 may be configured such that a turn-on delay time of the present invention becomes longer than that of a general LCD device.

That is, the power supply 830 or the light source part 810 may be configured in various types such that the turn-off delay time is shorter than the turn-on delay time.

The present invention increases an effect for decreasing consumption power in the dimming control method. As shown in a portion (a) of FIG. 5 and a portion (a) of FIG. 6, a slope A' on a graph of the turn-on delay time according to the present invention is more reduced than a slope A on a graph of a related art turn-on delay time. As shown in a portion (b) of FIG. 5 and a portion (b) of FIG. 6, a slope B' on a graph of the turn-off delay time according to the present invention is more reduced than a slope B on a graph of a related art turn-off delay time.

Comparing the LCD device (A' and B') according to the present invention with a related art LCD device (A and B), since the turn-on delay time A' of the LC device according to the present invention further increases, a block whose dimming is controlled becomes brighter more slowly, but since the turn-off delay time B' of the LC device according to the present invention further decreases, a block whose dimming is controlled becomes darker more quickly.

That is, when the light sources of the backlight unit 800 are turned on, the LCD device according to the present invention increases luminance slower than the related art LCD device, and when the light sources of the backlight unit 800 are turned off, the LCD device according to the present invention decreases luminance faster than the related art LCD device.

To provide an additional description, when turning off a light source, the present invention can reduce consumption power by quickly turning off the light source. When turning on a light source, the present invention can reduce consumption power by slowly turning on the light source.

That is, the present invention maximally extends a time where the light sources of the backlight unit are turned off, and thus can minimize the consumption power of the light sources.

As described above, when turning on/off the backlight unit according to the dimming control method, the present invention analyzes whether a current timing of the backlight unit is a turn-on timing or a turn-off timing and thus allows a turn-off delay time to become shorter than a turn-on delay time. Accordingly, by applying the local dimming control method, the present invention can more reduce consumption power.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display (LCD) device, comprising:

a panel driven by a data driver and a gate driver;

a timing controller configured to control the data driver and the gate driver, compare and analyze received video data to determine whether luminance has been changed to more than a predetermined value, and generate a dimming control signal according to the determined result; and a backlight unit configured to turn on or off a light source part according to the dimming control signal transferred from the timing controller, wherein the timing controller is further configured to determine whether the dimming control signal is to be an on-dimming control signal or an off-dimming control signal, to control the backlight unit to increase luminance of the backlight unit at a first linear slope from an OFF level to an ON level in response to determining that the dimming control signal is to be the on-dimming control signal, and to control the backlight unit to decrease the luminance of the backlight unit at a second linear slope from the ON level to the OFF level in response to determining that the dimming control signal is to be the off-dimming control signal, an absolute value of the first linear slope being less than an absolute value of the second linear slope such that a first time to increase from the OFF level to the ON level is longer than a second time to decrease from the ON level to the OFF level and wherein the OFF level corresponds to the light source part not emmiting light and the ON level correspondonce to the light source part emitting light.

2. The LCD device of claim 1, wherein the backlight unit comprises:

the light source part comprising a plurality of light sources for emitting light;

a power supply configured to supply power to the light source part for the light sources to emit light; and a light source driver configured to control the power supply or the light source part according to the dimming control signal to turn on or off the light sources corresponding to the dimming control signal, when the dimming control signal is received from the timing controller.

3. The LCD device of claim 2, wherein the dimming control signal comprises the off-dimming control signal and the on-dimming control signal, and the light source part or the power supply is configured with at least one switch or capacitor such that the absolute value of the first slope is less than the absolute value of the second slope.

4. The LCD device of claim 2, wherein each of the light sources comprises a light emitting diode (LED) string of which one or more LEDs are turned on or off simultaneously according to the dimming control signal, and each light source comprising the LED string is turned on or off in units of a block according to the dimming control signal.

5. The LCD device of claim 1, wherein the timing controller comprises:

a receiver configured to receive a timing signal and video data from an external system;

a buffer configured to store the video data, received through the receiver, by frame;

a determiner configured to compare and analyze each of blocks for the video data transferred from the buffer in units of a frame to determine which block comprises a light source to be turned on or off; and a dimming control signal generator configured to generate the dimming control signal for controlling the backlight unit according to the result determined by the determiner.

6. The LCD device of claim 1, wherein the backlight unit is turned on or off in units of a block according to the dimming control signal.

7. A driving method of a liquid crystal display (LCD) device, the driving method comprising:

receiving video data;

comparing and analyzing the received video data to determine whether luminance has been changed to more than a predetermined value;

determining whether the dimming control signal is to be an on-dimming control signal or an off-dimming control signal;

generating a dimming control signal for turning on or off a light source of a backlight unit according to the determined result;

controlling the backlight unit to increase luminance of the backlight unit at a first linear slope from an OFF level to an ON level in response to determining that the dimming control signal is to be the on-dimming control signal; and controlling the backlight unit to decrease the luminance of the backlight unit at a second linear slope from the ON level to the OFF level in response to determining that the dimming control signal is to be the off-dimming control signal, an absolute value of the first slope being less than an absolute value of the second slope such that a first time to increase from the OFF level to the ON level is longer than a second time to decrease from the ON level to the OFF level and wherein the OFF level corresponds to the light source not emitting light on ON level corresponds to the light source emitting light.

8. The driving method of claim 7, further comprising storing the received video data by frame, wherein the determining of luminance change comprises comparing and analyzing a current frame and a previous frame stored.

9. The driving method of claim 8, wherein the determining of luminance change comprises determining whether luminance has been changed to more than a predetermined value in units of a block of each frame.

10. The driving method of claim 8, wherein in the turning on or off of the light source of the backlight unit, a light source driver of the backlight unit receiving the dimming control signal controls a power supply which supplies power necessary for the backlight unit, and varies a voltage or a current supplied to a light source which is turned on or off according to the dimming control signal.

11. The LCD device of claim 1, wherein the timing controller is further configured to control the backlight unit to linearly increase luminance of the backlight unit at the first linear slope and linearly decrease the luminance of the backlight unit at the second linear slope.

* * * * *